United States Patent [19]

Krauss

[11] 4,352,569

[45] Oct. 5, 1982

[54] MIXING APPARATUS AND METHOD FOR MIXING

[75] Inventor: Werner Krauss, Hamburg, Fed. Rep. of Germany

[73] Assignee: Claudius Peters AG, Fed. Rep. of Germany

[21] Appl. No.: 272,572

[22] Filed: Jun. 11, 1981

[30] Foreign Application Priority Data

Jun. 14, 1980 [DE] Fed. Rep. of Germany ..... 3022346

[51] Int. Cl.[3] ..... B01F 13/02

[52] U.S. Cl. ..... 366/107; 366/341

[58] Field of Search ..... 366/3, 9, 101, 102, 366/103, 104, 106, 107, 341, 336

[56] References Cited

U.S. PATENT DOCUMENTS 3,216,629 11/1965 Goins ..... 366/336 X 4,239,421 12/1980 Krauss ..... 366/106 X

*Primary Examiner*—Billy J. Wilhite

*Assistant Examiner*—Arthur Dahlberg

*Attorney, Agent, or Firm*—Eric P. Schellin

[57] ABSTRACT

There is disclosed a mixing apparatus for mixing particulate bulk material. The apparatus consists of a cylindrical housing having distributed thereabout equidistantly a plurality of vertically disposed tubes. The tubes possess a series of vertically displaced entranceways that communicate with the housing containing the material and internally of the tubes for delivery of the material to a centrally located homogenizer in the lower portion of the apparatus. Entrance into the homogenizer is also accomplished directly from the bottom of the zone containing the material and means may also be provided at the top of the homogenizer for introducing therethrough the to-be-mixed material. The material is maintained in a highly fluidized condition by suitably positioned blowers having introductory orifices at strategic locations. The mentioned tubes are charged with the material through an air fluidizing means, which air is then deaerated so that the material may then be further transported to the homogenizer.

10 Claims, 10 Drawing Figures

MIXING APPARATUS AND METHOD FOR MIXING

BACKGROUND OF THE INVENTION

The invention relates to a mixing apparatus for bulk particulate material, with a multiplicity of outlets distributed over the vertical wall of the cylindrical apparatus communicating inwardly from the edge of the zone containing the particulate material. Descending vertical conduits are provided to communicate between said outlets and a collecting chamber.

It is known that the simultaneous or rapidly changing drawing-off of the material from various levels of the mixing apparatus into a common collecting chamber has a mixing effect since the material is brought together from different phases of temporary variations in composition (DE OS No. 1607773). However, when no special loosening devices are provided, the material flows to these outlets generally not in a uniform manner.

It is also known (DE-AS No. 1507906) to provide centrally in the mixing apparatus a draft flue which has—distributed over its height and its periphery—a multiplicity of outlets, each of them being complemented by a connected pneumatic conveyer chute which protrudes into the mixing apparatus and is designed to convey the pneumatically loosened material to the outlets. This, however, has led to no more satisfactory results. On the one hand it was found that around the draft flue in the area of the air conveyer, chutes operatively connected to the outlets have a narrow annular area formed so the material, due to stronger aeration was more prone to flow and was therefore more easily drawn off, while the greater portion of the mixing apparatus, namely, the areas more distant from the outlets, scarcely participated in the clearing process. On the other hand it was found that the particulate material enters the draft flue almost exclusively through the lowermost outlets, while the upper outlets remain more or less non-participatory. These observations present jointly a picture of poor apparatus clearing and mixing action.

The invention aims at improving the mixing action of the initially mentioned type.

The solution of the invention consists in a structure wherein, in front of each outlet an aeration device is arranged and the corresponding descending vertically disposed tube is deaerated, the collecting chamber being constructed as a homogenizer chamber.

It might have been expected that the aerating devices arranged at the periphery of the mixing apparatus according to the invention would, analogously to the observations on a mixing apparatus with corresponding aerating devices located as a central flue lead to the formation of a more rapidly flowing annular area in the outer zone, which area would exclude the more distant main area of the apparatus contents from the clearing and mixing action. This, however, is surprisingly not the case. This can perhaps be explained by the fact that in the case of the invention the aerating devices are more distant from each other and that therefore their effective ranges do not so readily overlap as in the known device.

Furthermore, one might have been compelled to fear that even in the case of the solution of the invention essentially only the lower material outlets would share in the drawing-off from all outlets essentially simultaneously. This might be traceable, on the one hand, to the pressure conditions in a series of equidistantly positioned vertical tubes. Since the tubes are deaerated, the higher hydrostatic pressure at the lower draw-off devices cannot expand to the entire space of the tubes and thus produce a counterpressure therein which cannot be overcome by the material in the upper draw-off devices. On the contrary, all draw-off devices encounter in these tubes an approximately uniform low counterpressure, so that they can also uniformly participate in the conveyance. On the other hand, the uniform draw-off of the material from all draw-off devices could be connected with the filling and clearing conditions in the tubes. Since these tubes are deaerated, the material in the bottom area of these tubes remains loose, especially in connection with a bottom aeration of these tubes, so that excessive pressure does not originate. On the contrary, the material in these tubes remains fluid so that it can be displaced by the material derived from the lower draw-off devices by means of a suitable choice of the loosening pressure prevailing in these draw-off devices. These draw-off devices participate therefore in the conveyance even when the material level in the tubes should steadily or periodically reach or pass beyond them. Should, by diversified filling and clearing conditions in the fall tubes different draw-off conditions be produced in the individual outlets, such conditions can be easily coped with by a suitable aeration control. By such a control care can also be taken that only limited filling levels in the tubes be produced. For instance, care can be taken that the filling level in the tubes not pass beyond the lowest outlet. The control can instead also be carried out in such a way that the outlets are actuated from the bottom to the top in sequence with increasing filling of the tubes. In operation, the lowest draw-off device can be actuated as the first one after the clearing of the corresponding tubes. As soon as it is reached by the material level or its level is substantially exceeded by that of the material, the next higher draw-off device is actuated, and so forth. When then finally the tubes have reached their maximum filling level, it is emptied into the homogenization chamber, and the process starts anew.

Finally, by the construction of the collecting chamber as a homogenization chamber the result is achieved that the material derived from the various locales of the zone is not only brought together, which would produce short-time variations in composition, but that it is intimately mixed. The combination of the draw-off from various locales on the one hand, and the homogenization on the other hand, therefore permit a mixing effect by which long-time as well as short-time variations in composition are compensated.

Suitably, the aeration devices at the outlets are positioned, at least partly within the zone containing the particulate material so that a loosening effect prevails within the said zone as well.

Furthermore, it is practical that the mentioned vertically disposed tubes be arranged in the zone having the particulate material and each of them be provided with a multiplicity of draw-off devices. This results in a very simple structure without the necessity of breaking through the walls of the mixing apparatus.

According to a further characteristic of the invention, the mentioned tubes are accessible and man-sized, so that each single outlet and the corresponding loosening devices can be inspected and malfunctions can be corrected.

A special characteristic of the invention consists in that the draw-off devices form within a closed space and ascending flow path. The purpose thereby achieved consists in that the material flow can be stopped by shutting-off the aeration flow with practically immediate effect. In a suitable embodiment the ascending flow path is formed by two diaphragm apertures of which the rear diaphragm aperture in the flow path occupies a higher position than the front one, and between the two diaphragm apertures propelling aeration device is provided. As long as the material to be drawn-off is loosened by aeration and behaves therefore similarly to a fluid, it is lifted by the aeration pressure to the level of the second diaphragm aperture. As soon as the aeration is finished, the material flow is stopped.

The possibility of shutting-off the draw-off elements makes an alternate operation thereof possible; for in mixing silos it provides advantageous to draw-off the material not only from different areas of the silo space, but also to carry out this draw-off in periodical variation in order to utilize at each individual draw-off point the advantages of funnel formation.

Advantageously, the homogenization chamber is arranged centrally with respect to the mixing apparatus and connected therewith directly via feed openings which may be arranged more or less centrally at the periphery of the homogenization chamber and/or in the top thereof. Thereby the draw-off at the periphery is supplemented by the outlets explained above by means of one or more centrally arranged openings, so that the draw-off movements and the funnel formation covers all cross-sectional areas of the mixing zone. Such an arrangement is particularly advantageous in mixing apparatus with large cross-sectional dimensions. In these structures, the homogenization chamber is suitably positioned, at least partly, in the mixing zone.

BRIEF DESCRIPTION OF THE DRAWINGS

In the following, the invention is described in greater detail with reference to the drawings which illustrate advantageous embodiments.

Figure 1:
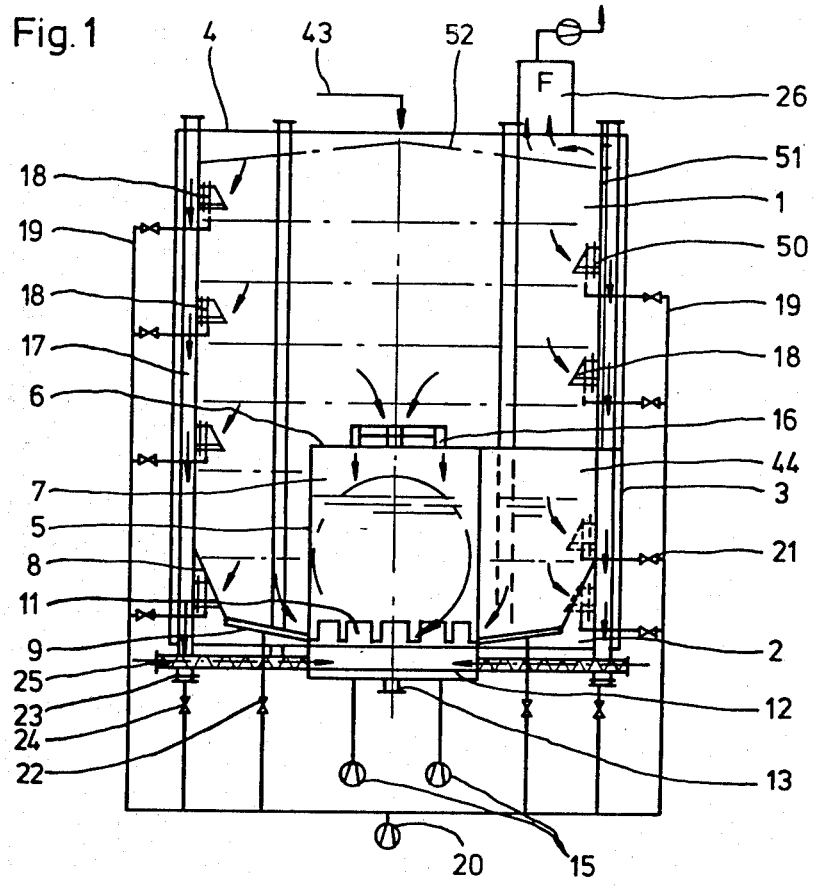
FIG. 1, is a vertical cross-section through a mixing apparatus of the present invention.
Figure 2:
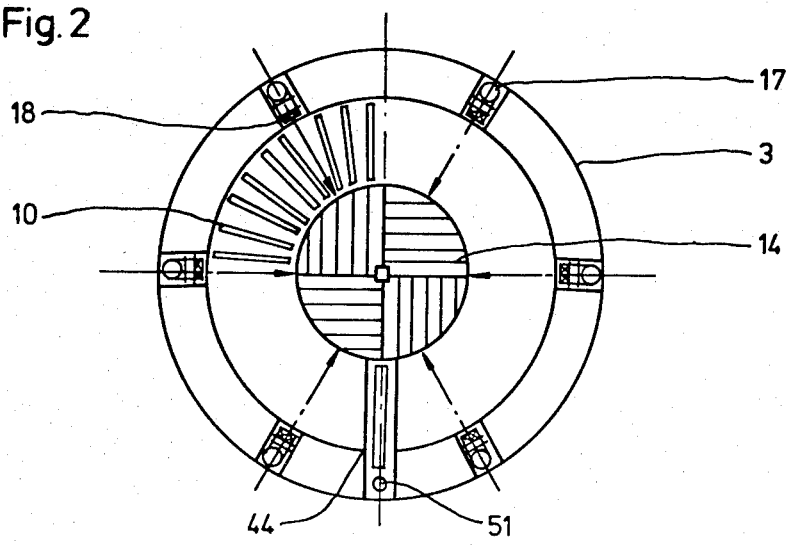
FIG. 2, is a horizontal cross-section of the device of FIG. 1.

Zone 1, charged with particulate material 52, of the mixing apparatus shown in FIGS. 1 and 2, is defined by a bottom 2, a cylindrical wall 3, and a top 4. Positioned concentrically within the zone is a homogenization chamber 7. The homogenization chamber 7 has a vertical cylindrical wall 5 and a top 6. Homogenization chamber 7 is connected to the cylindrical apparatus wall 3 by a narrow deaeration chamber 14 (see FIGS. 2 and 4) which is operatively provided at the bottom thereof with aeration devices 45 and is deaerated in turn by a vertically disposed deaerating pipe line 51 connected with free deaerated upper space of zone 1. The bottom of the mixing apparatus is provided with a rapidly sloping outer ring 8 and a less rapidly inclined inner ring 9. The said rings 8 and 9 define a funnel arrangement for the mixing apparatus. The inner ring 9 is provided with a plurality of radial air conveyer chutes 10 which feed the particulate material to passage openings 11 in cylindrical wall 5 of the homogenization chamber 7 whereby there is communication between the zone 1 and internally of the homogenization chamber.

Bottom portion 12 of the homogenization chamber occupies a somewhat lower position than the bottom 2 of the mixing apparatus and is provided with a lower outlet 13 (not shown in detail). The floor of the bottom portion 12 of the homogenization chamber 7 is provided with aeration devices 14 which are actuated preferably along a quadrant sequence by blowers 15 in such a way that the entire material contents of the homogenization chamber is fluidized, made to revolve strongly and thereby is mixed intimately all in a known manner. In the top 6 of the homogenization chamber, one or more outlets, as indicated at 16, are arranged through which the material can also directly flow from the zone 1 into the homogenization chamber.

Near the cylindrical wall 3 of the mixing apparatus there are six vertically positioned tubes 17. They communicate at various vertically displaced levels by means of a plurality of outlets 50 to which draw-off devices 18 are connected so as to be positioned in front of them. There are aeration devices for these draw-off devices to which air is supplied by a blower 20 via a pile line 19. Valves 21 are positioned in front of each draw-off device 18, which valves are constructed in a manner such that they permit a programmed, serial aeration of different groups of draw-off devices. Blower 20 feeds also radial air conveyer chutes 10 on the inner ring 9 of zone 1 which are likewise, as indicated by valves 22, controllable in desired chronological sequence. Finally, aeration devices 23 are provided at the lower end of each vertically positioned tube 17 which are likewise supplied by air blower 20 and to which, if so desired, according to a preselected program, compressed air can be supplied via valves 24.

Each of the vertically positioned tubes 17 are connected, at the lower end, with screw conveyer 25 which feeds the material to the homogenization chamber 7.

In the top 4 of the apparatus, entrance hatches-not shown-are provided through which the vertically positioned tubes and the draw-off devices can be reached for servicing. In some cases accessibility to the vertically positioned tubes and draw-off devices from the outside (i.e., from the zone 1) may suffice. Preferably, however, is an embodiment wherein the vertically positioned tubes as such, are man-sized, so that the draw-off devices and vertically positioned tubes can be serviced even when the apparatus is full.

On the apparatus roof, a filter 26 is provided with which deaeration pipe lines, not shown, and the equidistantly spaced vertically positioned tubes 17 are connected. These tubes may be provided with deaeration openings to the free upper zone 1 which in turn is connected with the filter 26. In the vertically positioned tubes, the draw-off openings 50 are formed. Attention is now directed to FIGS. 5,6,7 and 8. A casing section 27 is in each case firmly and securely connected with the edge of an opening 50—not directly visible in the drawing—which casing section is closed on top, on the bottom and at the sides. It is supplied at its open frontside with a flange 28. To this flange 28 there is secured a diaphragm 29. There, then follows a flange 30 so that the diaphragm 29 is sandwiched between the two flanges. Thereafter there is a mid-section 31 which is likewise closed, in a casing-like manner, on top, on the bottom and at the sides. However, its bottom 32 is constructed with aeration means with a manifold connected to an air supply line 33. At the open frontside of mid-section 3 is a flange 34 with which, it cooperates with another flange 36 to sandwich another diaphragm 35. Front element 37 is forward of that. This front element has a short top 38, a rather longer aeration manifold 38 which is likewise supplied from air supply line 33. The front element has side walls 40. The front of the front of element is completely open. If diaphragm 29,35 were not present, the combination of elements 27, 31 and 37 would form uninterrupted casing-like channel to vertically positioned tubes 17 whose wall has an opening that corresponds to the clear cross section of these elements to form an unimpeded entranceway.

In some cases a draw-off devie may be usable without diaphragm 29, 35. The material flowing into the casing area becomes, due to the aeration through aeration bottoms 32, 39 flowable and can therefore flow into vertically disposed tubes 17. When, however, as is preferably the case, a multiplicity of such draw-off devices is provided, the material flow can become too strong. Moreover, the material can, after the shutting off of the aeration, flow through aeration bottoms 32, 39 too strongly and too long. This is so because the aeration bottom 39 of front element 40 aerates not only the material already present in the device but to a certain extent also material that is still positioned in the free zone 1 in front of or above the device. This material has still a rather small gradient and is therefore pushed by the to-be-mixed particulate material's own hydrostatic pressure. When, however, according to the invention diaphragms 29, 35 are provided, of which diaphragm 35 has a diaphragm triangularly shaped aperture 41 located in the lower area, and rearwardly positioned diaphragm 29 has a rectangularly shaped aperture 42 located in the upper area, the material flow is rapidly stopped as soon as the aeration through aeration bottoms 32, 39 is interrupted as the material must follow a tortuous path. The illustrated draw-off device is therefore a rapidly acting valve and permits therefore the relatively rapidly changing draw-off from different zone 1 areas. Diaphragms 29, 35 serve also for adjustment of the amount of material flowing at each instant through a draw-off device at regular aeration. It may in fact be suitable to make the cross sectional passages not uniform but-depending e.g. on the level difference-different in order to thereby make possible a uniform draw-off from all level areas. The investment cost for such devices is comparatively small since the vertically positioned tubes are commercially available products and can be simply fastened to the mixing apparatus wall or are in any other suitable position.

The device operates in the following manner:

The mixing apparatus is filled according to arrow 43. It forms, e.g., cone 52. It may be supplied with a continuous supply of particulate material which corresponds to that which is steadily drawn-off thereby maintaining zone 1 in a filled state. For instance, it may be provided that some material is fed through openings 16 centrally into the homogenization chamber, while in periodical alternation individual sectors of aeration bottom 9 are supplied with compressed air, so that from these bottom zones material flows through openings 11 into the homogenization chamber. It is also possible to switch on and off single or several of the draw-off devices 18 in groups, so that a reliable cross section easily determinable by tests, flows through the entire material contained in the zone 1 into the homogenization chamber 7. It depends on the diameter of the apparatus whether possibly the draw-off through the draw-off devices 18 at the periphery of the apparatus suffices or whether simultaneously or in periodical alternation therewith also the draw-off devices provided at the homogenization chamber, namely the devices 11 and/or the devices 16 are put into operation.

When in connecton with the invention it was stated that the vertically positioned tubes are suitably provided at the periphery of the zone 1, this does not mean that they must be arranged directly at the external wall although this is suitable for reasons of stability. They may also be positioned at a certain distance from the external wall. They should, however, (in contrast to the central arrangement of draw-off devices or the draft flue in the prior art) be positioned so close to the periphery of the zone 1 so that they are equidistant from each other and their draw-in areas (funnel or aeration areas) do generally not merge into a common and uniformly moving system wherein the material preferably flows to the outlets with avoidance of the remaining zone 1. From these viewpoints. an arrangement with the outlets as closely as possibel to the external boundary of the zone 1 is most advantageous. In many cases satisfactory conditions prevail even at a certain distance of the outlets from the periphery of zone 1 space.

Figure 3:
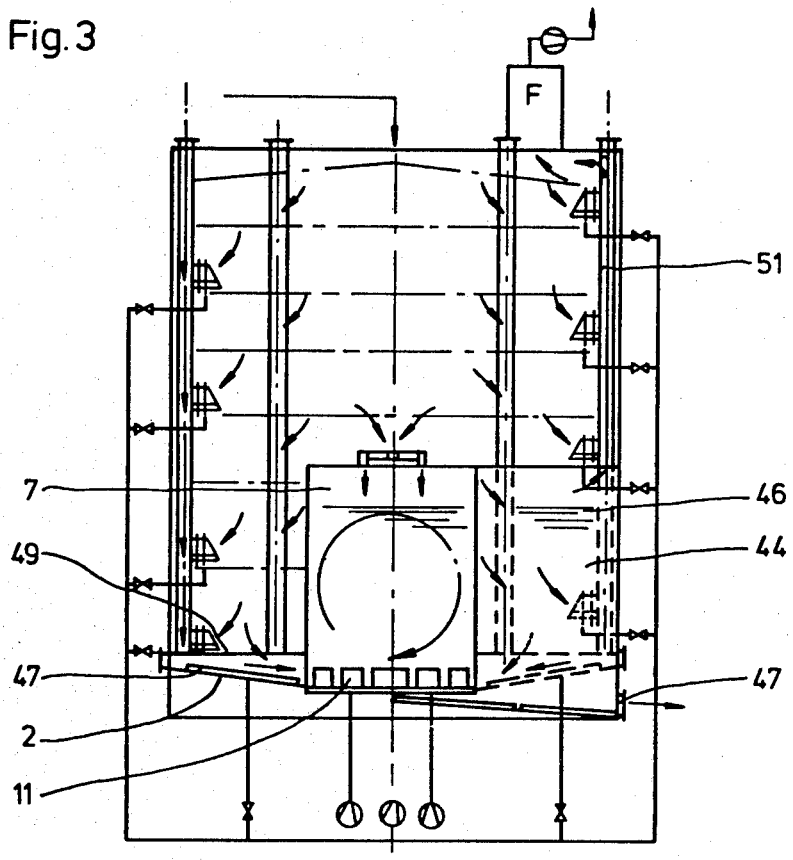
FIG. 3, is a vertical cross-section of another embodiment of another mixing apparatus.
Figure 4:
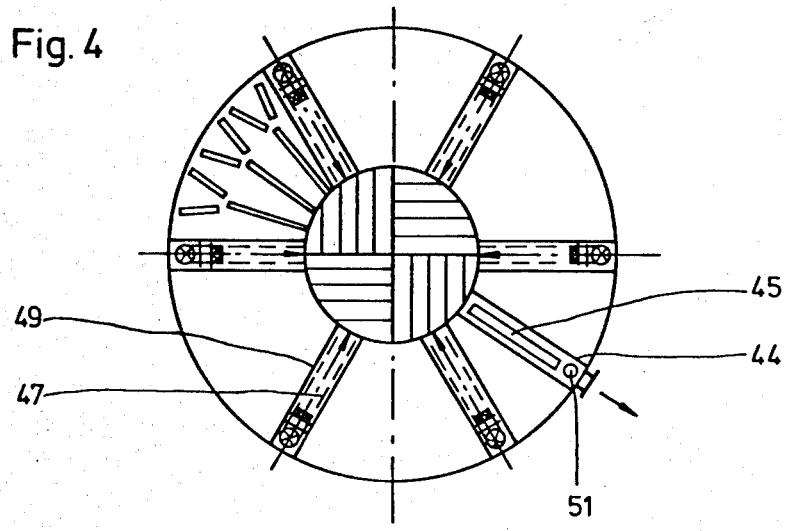
FIG. 4, is a horizontal cross-section of the device of FIG. 3.
Figure 5:
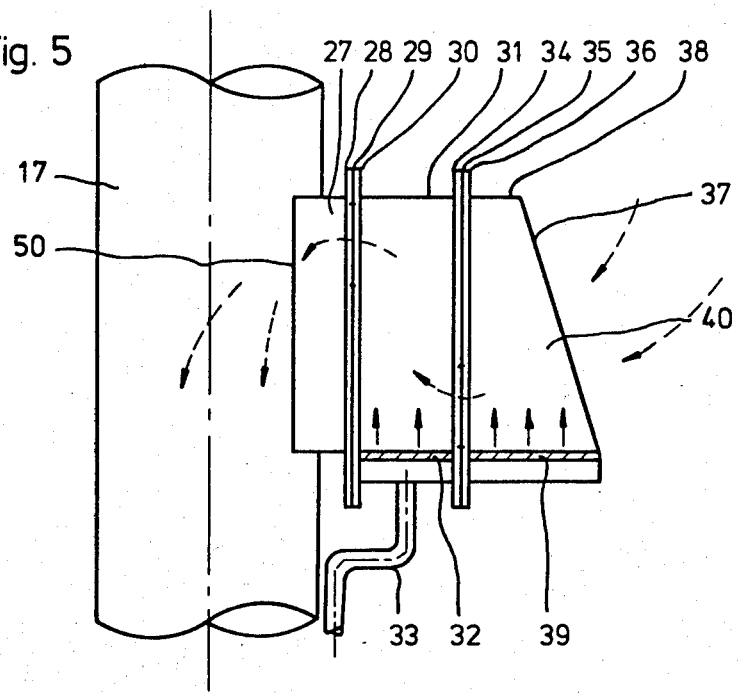
FIG. 5, is side elevation of an entranceway with aeration device.
Figure 6:
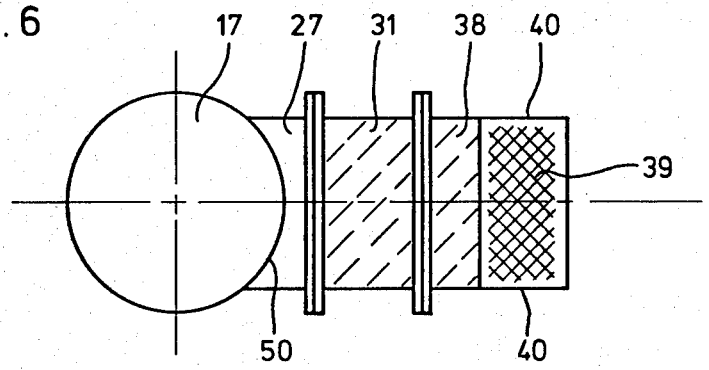
FIG. 6, is top planview corresponding to FIG. 5.
Figure 8:
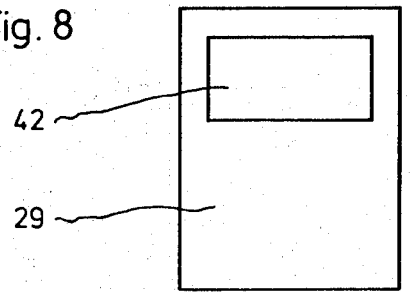
FIGS. 7 and 8, illustrate diaphragm forms having apertures.
Figure 7:
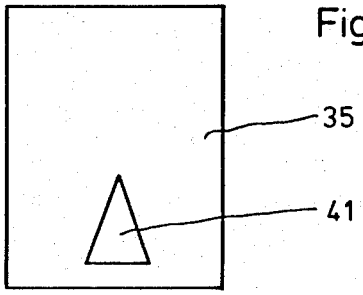

The embodiment of FIGS. 3 and 4 differs from that of FIGS. 1 and 2 by the following characteristics. The structure of the bottom 2 does not have the sloping external ring 8. The conveyance from the vertically positioned tubes 17 into the homogenization chamber takes place, instead, of by means of screw conveyer, by radially and inclined arranged air conveyer chutes 47 which are enclosed by a covered channel 49. The draw-off of the material takes place through the dearation chamber 44 constructed as a draining chamber, which is provided at the bottom with aerating devices 45, so that here, too, as in FIG. 1, the material in this chamber ascends communicatingly about as high as in the homogenization chamber 7, as is indicated at 46. The material is then drawn off from the bottom of this chamber through a suitably disposed pipe connection 47.

Figure 9:
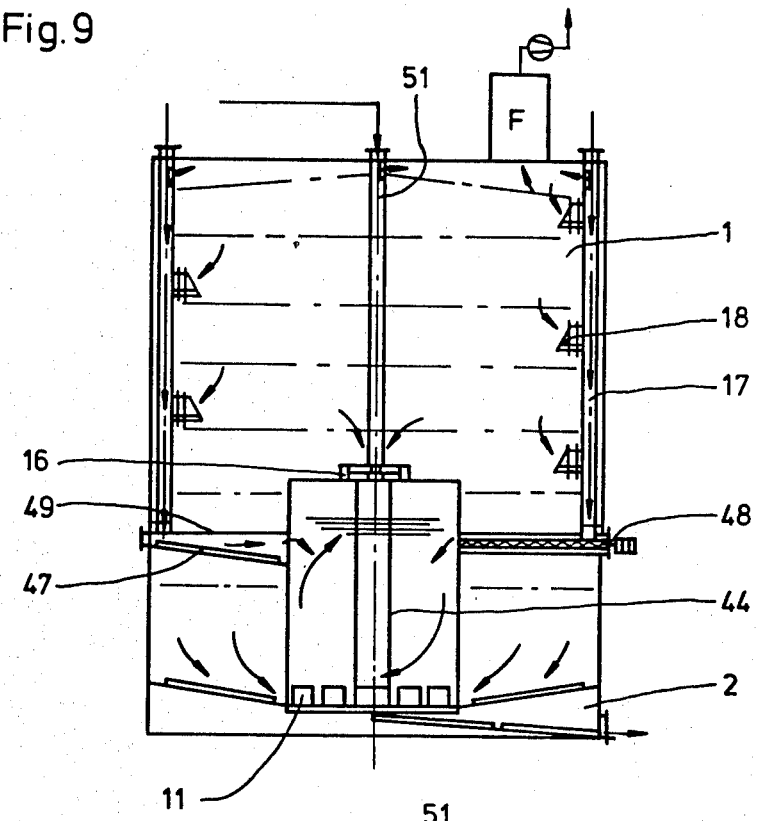
FIGS. 9 and 10, are further embodiments of the mixing apparatus taken in vertical cross-section.

The embodiment of FIG. 9 differs from those of FIGS. 1, 2 and 3, 4 in that the material is fed from the vertically positioned tubes 17 into homogenization chamber 7 at a certain distance above bottom 2 of the apparatus, for which purposes air conveyer chutes 47 or screw conveyers 48 are provided. The mode of operation is, however, the same as described with reference to FIGS. 1 and 2.

Figure 10:
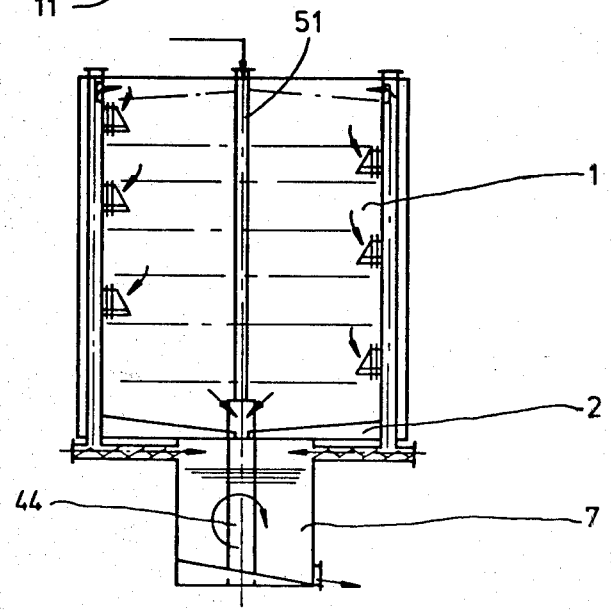

This applies also to the apparatus of FIG. 10 wherein the homogenization chamber is not positioned, entirely or partly, within silo space 1 but is lowered to a position below bottom 2 thereof. The homogenization chambers are in these embodiments of course also deaerated in a suitable manner not shown in the drawing.

What is claimed is:

1. A mixing apparatus for mixing particulate bulk material comprising a housing, said housing having a lower portion and a vertically disposed side wall adapted and constructed to define a zone having a bottom for the material, a plurality of vertical tubular means distributed in spaced relationship proximate said side wall, said vertical tubular means having a bottom, said vertical tubular means having a plurality of vertically displaced entranceway means adapted and constructed to communicate with said zone and internally of said vertical tubular means whereby the material may flow from said zone into said vertical tubular means, mixing chamber means positioned in said lower portion of said housing, collection and distribution means communicating with the bottom of said tubular means and said mixing chamber whereby the material from said vertical tubular means is charged into said mixing chamber means, means for introducing material from the lower portion of said housing into said mixing chamber means, aeration means for distribution of pressurized fluidizing gas into said entranceway means, into said bottom of said zone and into said mixing chamber means and means for removing mixed material from said mixing chamber means.

2. The mixing apparatus of claim 1 wherein the said entranceway means is an elongated horizontally disposed open-ended housing projecting communicatingly radially from said vertical tubular means and communicatingly into said zone, said housing having upwardly facing aeration means in the bottom thereof whereby material flowing into said entranceway means is fluidized and is driven in the direction of said vertical tubular means.

3. The mixing apparatus of claim 2 wherein the open-ended housing is subdivided by bulkhead means having suitably positioned apertures therethrough whereby the material driven by said aeration means describes a tortuous path in the direction of the vertical tubular means.

4. The mixing apparatus of claim 3 wherein means is provided in said vertical tubular means to deaerate said material as it is collected at the said bottom.

5. The mixing apparatus of claim 1 wherein the bottom of the said zone includes downwardly radially inwardly.

6. The mixing apparatus of claim 5 wherein upwardly extending vertical means is provided in said bottom for introduction of fluidizing gas into said zone.

7. The mixing apparatus of claim 1 wherein the collection and distribution means includes a driven screw conveyer.

8. The mixing apparatus of claim 1 wherein the collection and distribution means includes an inclined downwardly radially disposed chute.

9. The mixing apparatus of claim 1 wherein the mixing chamber means terminates with a top portion positioned substantially below the uppermost level of said material when said zone contains material and said top portion of said mixing chamber has communication means for introducing material from said zone into said mixing chamber.

10. The method of mixing particulate material comprising providing a first zone of particulate material having a vertical and a horizontal dimension providing a plurality of exit zones vertically along said vertical dimension of said first zone, removing portions of said particulate material from said exit zones by employing fluidizing gas, collecting said removed portions of said particulate material, distributing said particulate material into a fluidized mixing zone, centrally and essentially below said fluid zone, introducing portions of said particulate material from lower portions of said first zone into said fluidized mixing zone and removing said mixed particulate material from said fluidized mixing zone.

* * * * *